US005711174A

United States Patent [19]

Dohi et al.

[11] Patent Number: 5,711,174

[45] Date of Patent: Jan. 27, 1998

[54] ROLL FORMING METHOD AND DEVICE

[75] Inventors: Masahiro Dohi, Hiroshima; Yoshiyuki Yamashina, Sakai, both of Japan

[73] Assignees: Mazda Motor Corporation, Hiroshima; Samtech Corporation, Osaka, both of Japan

[21] Appl. No.: 682,978

[22] Filed: Jul. 16, 1996

[30] Foreign Application Priority Data

Jul. 20, 1995 [JP] Japan ..... 7-184007

[51] Int. Cl.[6] ..... B21D 22/16

[52] U.S. Cl. ..... 72/83; 72/85

[58] Field of Search ..... 72/81, 82, 83, 72/85, 96

[56] References Cited

U.S. PATENT DOCUMENTS 3,262,191 7/1966 Albertson et al. ..... 72/85

FOREIGN PATENT DOCUMENTS 293 281 8/1991 German Dem. Rep. ..... 72/83

59-173724 11/1984 Japan ..... 72/83

5-76982 3/1993 Japan .

*Primary Examiner*—Lowell A. Larson

*Attorney, Agent, or Firm*—Martin Fleit, P.A.

[57] ABSTRACT

A roll forming method is used for forming an annular product with a radially outwardly extending flange portion at an end and includes steps of holding a center portion of a work for forming the annular product by a holding device, rotating the work, contacting a circumferential end portion of the rotating work with a forming roller to be pressed to form the flange portion while retaining a circumferential outer end of the work. The present invention is advantageous in that the resultant product has a good quality without deficiency, such as underfill of the material and has an improved toughness unlike a cast product, a product made by welding and the like of the same structure.

9 Claims, 5 Drawing Sheets

ROLL FORMING METHOD AND DEVICE

BACKGROUND OF THE INVENTION

1. Field of the Invention

The present invention relates to a roll forming of products.

2. Related Art

As a method for forming products having a cylindrical portion, for example, Japanese Patent Un-Examined publication No. 5-76982, laid open to the public in 1993, discloses a method in which at first a steel plate of a predetermined thickness as a starting material is prepared. Then, the steel plate is set at a tip end of a mandrel, and disposed to forming rollers around the mandrel to make the forming rollers contact with the steel plate. The forming rollers are moved relative to the steel plate so as to form a cylindrical portion by means of a roll forming method.

It should, however be noted that the method disclosed in the above Japanese publication cannot apply to forming of a product with a cylindrical portion and a flange portion radially extended from a top end of the cylindrical portion, such as a clutch drum used in an automatic transmission. Although these shapes of products can be formed by a casting, they are brittle and thus are not able to be used for such clutch drum on which a substantial force acts. Conventionally, in order to form such clutch drum, an intermediate product having a cylindrical portion is formed in accordance with a method as disclosed in the Japanese Patent Un-Examined Publication No. 5-76982. Then, the intermediate product is joined with another member with a flange at the tip end by means of a welding or the like to form the clutch drum of a hat like configuration in cross section as a final product.

However, the above method for forming the clutch drum by joining the cylindrical member with a flange member is disadvantageous in that a manufacturing cost is increased because of the increase of the number of processes and thus a manufacturing efficiency is reduced as well. In addition, a joint portion in the product formed by the welding tends to be defective and therefore it is difficult to maintain a desirable quality.

In order to form such product of a hat like configuration in cross section through a single process, if a mandrel by which a flange portion is able to be formed at an end of the cylindrical portion is prepared and a method as disclosed in the Japanese Patent UnExamination Publication No. 5-76982 is employed to form the product, there would be a fear that an underfilled portion is formed in the product and thus it is difficult to obtain a desirable quality of the product.

SUMMARY OF THE INVENTION

It is therefore an object of the present invention to provide a roll forming method in which a desirable quality of a final product of the above unique configuration can be formed without any deficiency through a substantially single process.

Another object of the present invention is to provide a device for carrying out the above method.

A further object of the present invention is to provide a product formed by the above method and device.

The above and other objects of the present invention can be accomplished by a roll forming method for forming an annular product with a radially outwardly extending flange portion at an end comprising steps of holding a center portion of a work for forming said annular product by a holding device, rotating the work, contacting a circumferential end portion of the rotating work with a forming roller to be pressed to form said flange portion while retaining a circumferential outer end of the work.

In a preferred embodiment, the holding device comprises a mandrel for holding the center portion of the work at one end and a tail stock disposed opposite to the mandrel for urging the work at the other end against the mandrel. The work is pressed against the mandrel by the forming roller so that the work is formed to be of a configuration that the work covers the mandrel. Preferably, the mandrel is formed with a forming tooth portion at a circumferential surface so that a corresponding tooth portion is formed on an inner surface of the work. It is preferred that the forming roller is moved along an outer surface of the mandrel in an axial direction of the mandrel while pressing the work against the outer surface of the mandrel. The roll forming method may further comprise a step of pressing the work against a stepped portion radially extending by the forming roller to form the flange portion while suppressing an outer end of the work being extended radially outwardly by a retaining roller.

In another aspect of the present invention, a roll forming device for forming an annular product with a radially outwardly extending flange portion at an end is provided. The roll forming device comprises a holding device for holding a center portion of a work for forming the annular product, rotation means for rotating the work held by the holding device, one or more forming rollers for being brought into contact with a circumferential portion of the work to press against the mandrel so as to from the flange portion, and restricting means for suppressing an outer end of the work to restrict a radially outward extension of the work. In a preferred embodiment, the holding device includes a mandrel for holding the center portion of the work at one end and a tail stock disposed opposite to the mandrel for supporting the work at the other end. The mandrel may be formed with a radially outwardly expanded stepped portion for forming the flange portion.

Preferably, the mandrel is formed with a tooth portion on an outer surface for forming a corresponding tooth portion on an inner surface of the work. In a preferred embodiment, the restricting means is a retaining roller which is brought into contact with the outer end of the flange portion of the work while rotating.

According to the present invention, a cylindrical steel material as a starting material is prepared for forming a product of a hat like configuration in cross section. Where a final product is a clutch drum of an automatic transmission, a disc like plate with a hollow boss portion at a center is prepared as a starting material. The material is mounted on a mandrel with a central portion of the material being borne by the mandrel. The material is carried by a tail stock in an opposite direction to be secured on the mandrel. Then, a reciprocating device provided with the forming roller and the restriction means is positioned at the material or work on the mandrel and the roller and restriction means are brought into contact with the work at a predetermined position. In this case, the forming roller is brought into contact with the surface of the work to form a cylindrical portion in the first place. Namely, the forming roller is contacted with the outer surface of the work at a predetermined offset position in a radial direction and moves along the surface of the work while deforming the work. In this case, the work is rotated relative to the forming roller so that forming process of the work is proceeded as the work is rotated.

When the cylindrical portion is formed in a predetermined area of the work, a tip end of the work is abutted against a stepped portion extending radially outwardly. Then, the work is deformed to extend radially outwardly along the stepped portion to form the flange portion. In this case, the outer end of the work is suppressed by the restricting means. As a result, the work is pressed at a tip end of the cylindrical portion and a base end of the flange portion by the forming roller toward the mandrel or in an inward and forward direction in which the forming roller is moved. Concurrently, the work is suppressed at the outer end of the flange portion by the restricting means radially inwardly. The restriction means presses the outer end of the flange during the forming process so that the material can be effectively supplied to a corner portion of the stepped portion of the mandrel. As a result, it is prevented from forming an underfill of the material in the product, specifically around the tip end of the cylindrical portion and base end portion of the flange portion.

Further objects, features and advantages of the present invention will become apparent from the Detailed Description of Preferred Embodiments which follows when read in light of the accompanying Figures.

DETAILED DESCRIPTION OF THE PREFERRED EMBODIMENTS

Hereinafter, the present invention is described in detail taking reference with the attached drawings.

Figure 1:
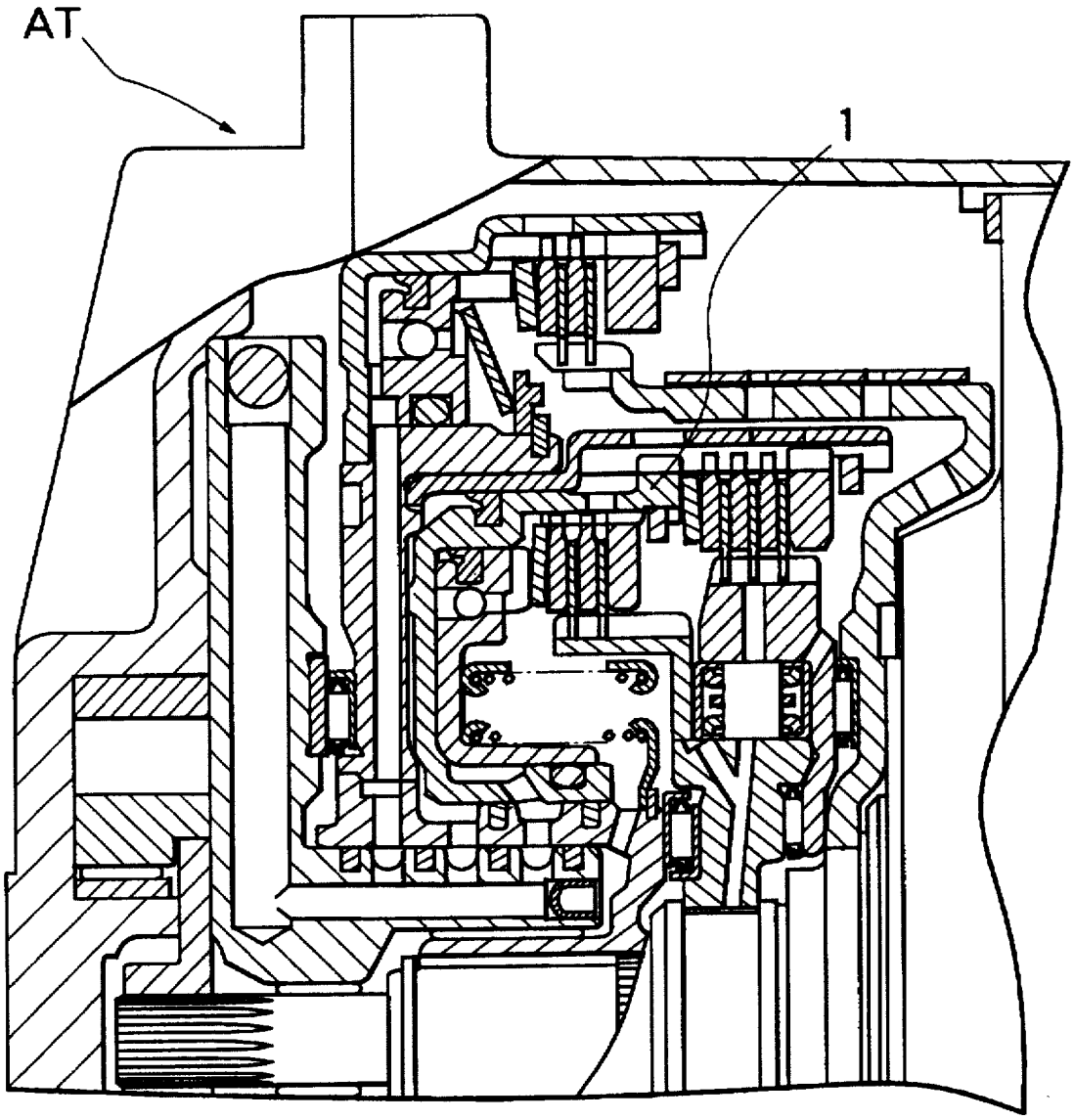
FIG. 1 is a cross sectioned partial view of an automatic transmission to which a clutch drum which can be formed by means of a rolling method in accordance with the present invention can be incorporated.

Referring to FIG. 1, there is shown a partial sectional view of an automatic transmission provided with a 3-4 clutch drum 1 (coasting clutch drum) to which the present invention can be applied. The structure of the automatic transmission is commonly known and is not relevant to the present invention. Therefore, a detailed explanation thereto is omitted.

Figure 2:
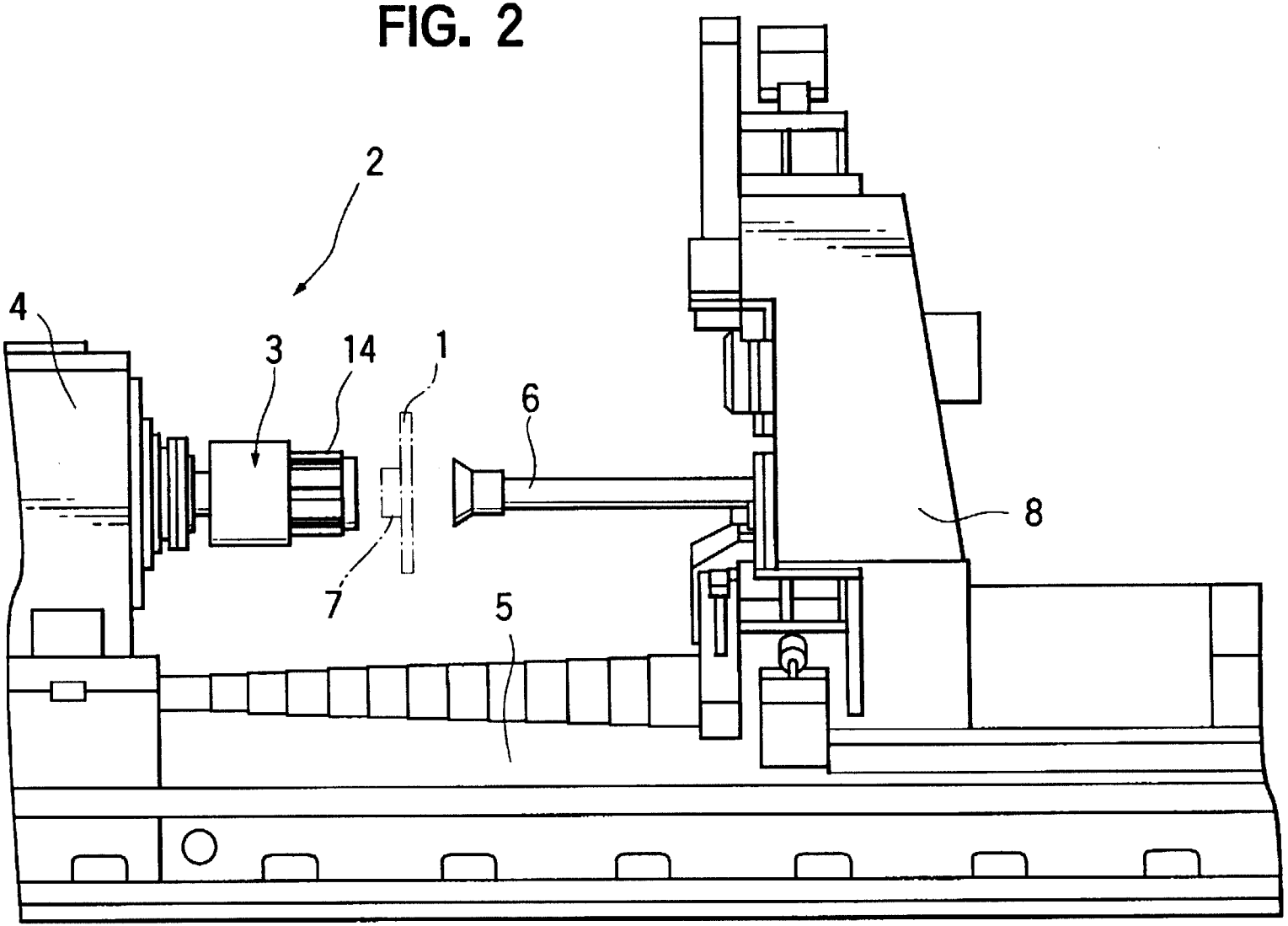
FIG. 2 is a schematic front view of a roll forming device.
Figure 3:
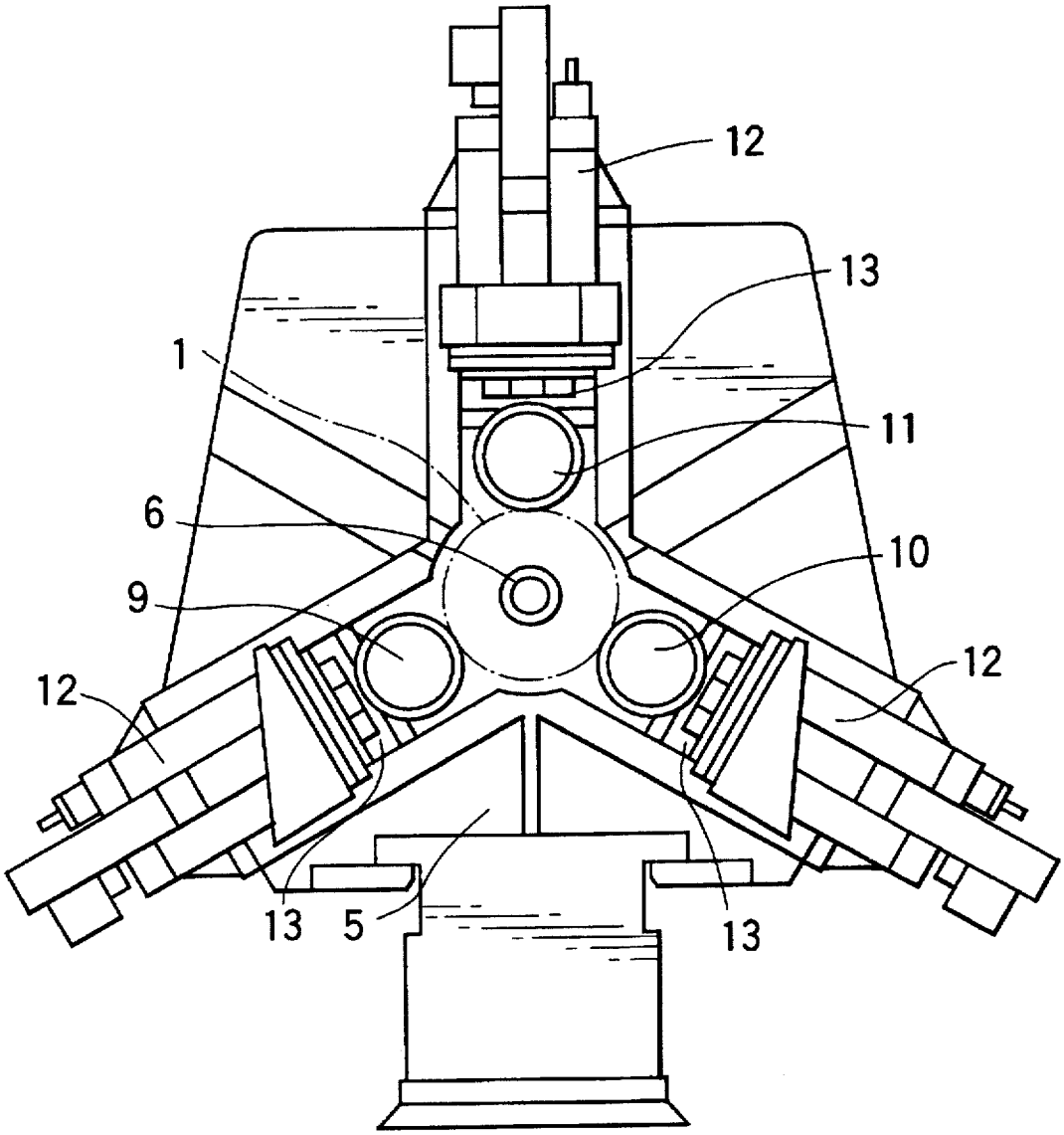
FIG. 3 is a schematic side view of a roll forming device.

Referring to FIGS. 2 and 3, there is shown a schematic view of a roll forming device 2 in accordance with the present invention.

Figure 4:
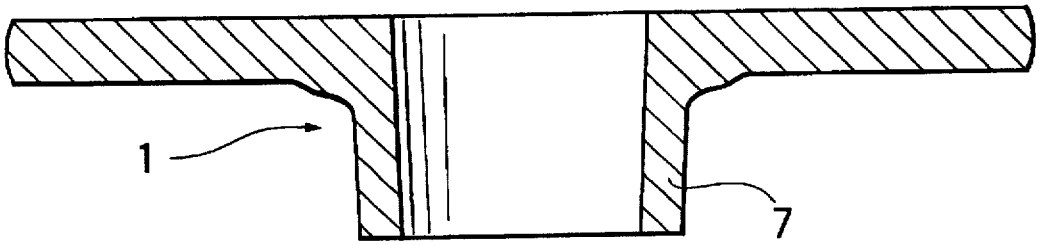
FIG. 4 is a sectional view of a starting material to be formed in accordance with the present invention.

The roll forming device 2 of the present invention is provided with a main shaft support 4 having a mandrel 3 and a retaining rod or tail stock 6 making a reciprocating movement by means of a cylinder device (not shown) on a base 5. A work or material for forming the clutch drum 1 is held by a horizontal shaft portion of the mandrel 3 and the tail stock 6. In this case, the work 1 is of a disc like configuration, as shown in FIG. 4, having a hollow boss portion 7 in a center position. The work 1 is held in a manner that a rotation center axis of the boss portion is accorded with a center axis of the mandrel. In addition, the roll forming device according the present invention is provided with a reciprocating support 8 which is disposed opposite to the main shaft support 4. The reciprocating support 8 is movably disposed on the base 5 relative to the main shaft support 4. Namely, the support 8 is able to move on the base 5 in an axial direction of the mandrel 3 to and from the work 1. The tail stock 6 is centered to align with the axis of the mandrel 3. Two forming rollers 9 and 10 and a retaining roller 11 are disposed around the center axis of the tail stock 6 or the center axis of the work at points which are provided by dividing a circle into three equal angles.

The respective rollers 9, 10 and 11 are mounted on sliders 13 which can make reciprocating movements in radial directions by means of cylinders 12 respectively. Thus, the rollers 9, 10 and 11 can move in the radial directions as the sliders 13 make reciprocating movements. The mandrel 3 is formed with splines 14 at a range on the outside thereof distant from the tip end by a predetermined length.

Figure 5:
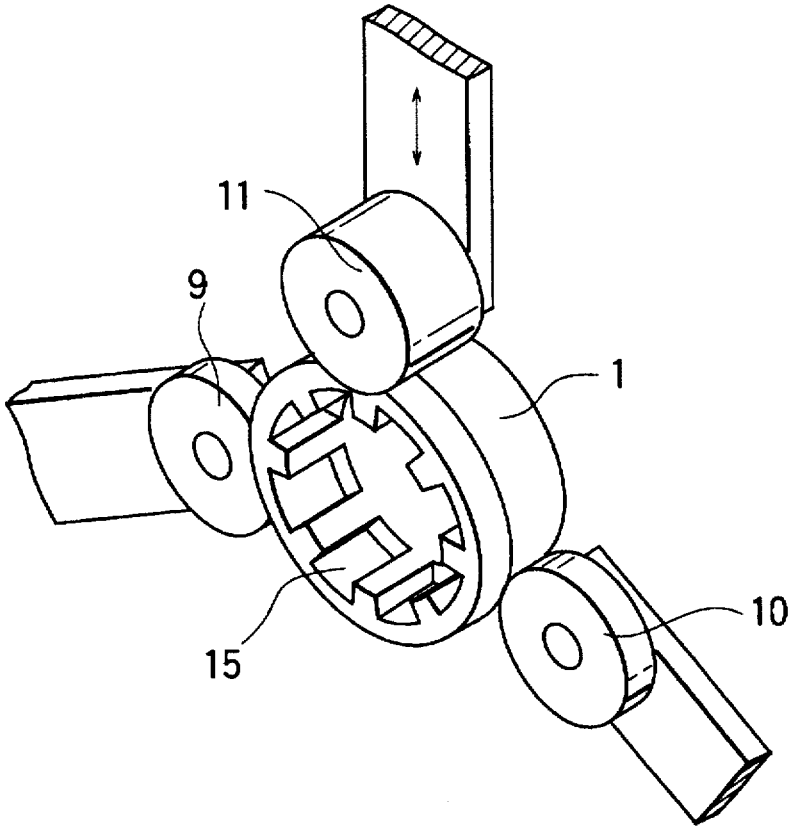
FIG. 5 is a perspective view showing an engaged relationship between a work and rollers of the roll forming device of the present invention.

The splines 14 of the mandrel are brought into a spline engagement with spline teeth 15 formed on an inner surface of the work 1 as shown in FIG. 5. The mandrel 3 is mounted on the main shaft support 4 so as to be rotated by a power source (not shown). Hereinafter, a roll forming process for forming the 3-4 clutch drum 1 by using the roll forming device 2 will be explained.

Figure 6:
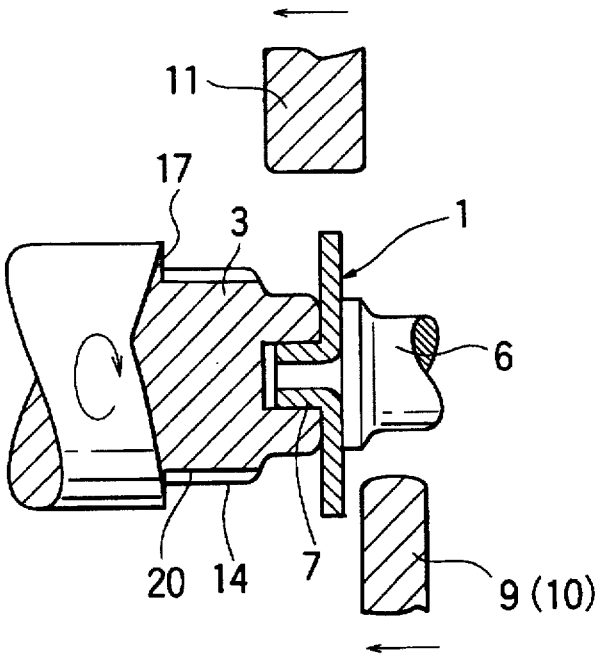
FIGS. 6, 7 and 8 are partial sectional views showing the roll forming process according to the present invention in different stages respectively.

Referring to FIG. 6, in this preferred embodiment, the final product is the clutch drum 1 of the automatic transmission. Thus, a disc like material with a hollow boss portion 7 at a center is prepared. This material or work 1 is mounted on the tip end of the mandrel 3 and pressed by the tail stock 6 against the mandrel 3 to be securely held between the mandrel 3 and the tail stock 6. Then, the reciprocating support 8 provided with the forming rollers 9 and 10 and the retaining roller 11 is moved toward the work 1 on the base 5 in the axial direction of the mandrel. Next, the rollers 9, 10 and 11 are moved in the radial directions close to the work 1. In this case, the forming rollers 9 and 10 are positioned radially spaced from the outer surface by a distance substantially equal to a thickness of a formed product.

Figure 7:
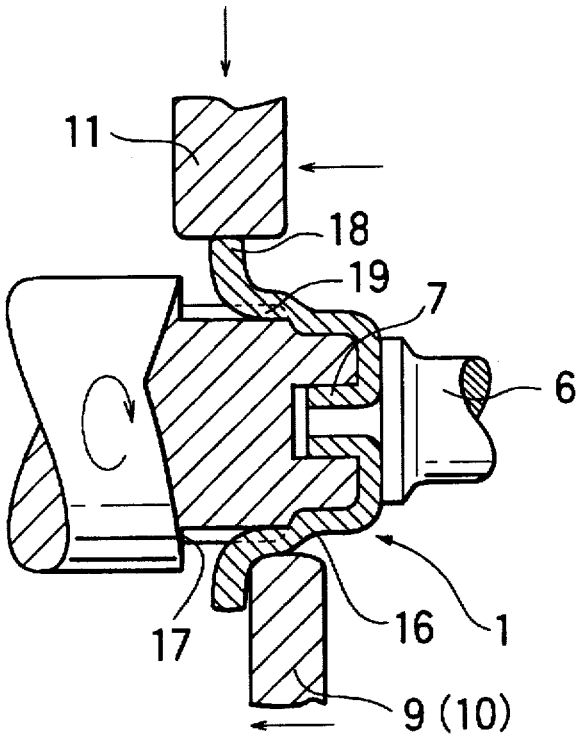

Next, the forming rollers 9 and 10 are brought into contact with the work to form a cylindrical portion, that is, a drum portion of the product. In this case, the forming rollers 9 and 10 are contacted with the work 1 radially offset from the center of the mandrel 3 by a predetermined distance as the work 1 is being rotated by the mandrel 3. The forming rollers 9 and 10 are forwarded along the axial direction of the mandrel to proceed with the forming process while maintaining the above positional relationship with the mandrel 3. In this case, where the mandrel 3 is formed with a stepped portion, the forming rollers 9 and 10 are radially outwardly retreated from the mandrel 3 by a predetermined distance corresponding to a height of the stepped portion to continue the forming action (see FIG. 7).

Figure 8:
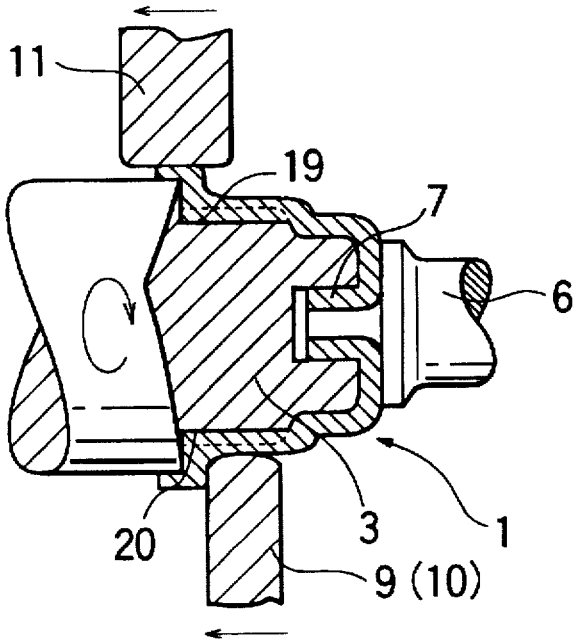

As aforementioned, the work 1 is rotated relative to the rollers 9 and 10 so that the forming action is proceeded while the work 1 is rotated. When the cylindrical portion 16 is formed for a predetermined range, the tip end of the work 1 is abutted against a stepped portion or a vertical wall 17 formed on the mandrel 3 which extends in the radial direction with regard to the central axis of the mandrel 3. Then, the work 1 is deformed to extend radially outwardly so as to form a flange portion 18. In this case, the outer end of the work is suppressed by the retaining roller 11 as shown in FIG. 8. In detail, the work 1 is pressed against a corner portion formed by the vertical wall and an outer surface of a horizontal shaft portion of the mandrel 3 at the tip end of the cylindrical portion 16 and a base portion 19 of the flange portion 18. Concurrently, the work 1, which is forced to be deformed radially outwardly due to the pressing action of the forming rollers 9 and 10, is suppressed by the retaining roller 11 at the outer end of the flange portion 18. By suppressing the outer end of the flange portion 18 of the work 1, the material of the work 1 is effectively supplied to the corner portion 20 formed by the vertical wall and the outer surface of the mandrel 3. As a result, it is prevented that an underfill of the material is produced in the corner portion, or the base portion of the flange portion 18.

As aforementioned, according to the present invention, a product with a rather complicated configuration, such as a hat like configuration in cross section, can be formed through substantially a single process although it includes plural consecutive steps. Thus, the forming method according to the present invention is efficient and is able to reduce the manufacturing cost.

In addition, the present invention is advantageous in that the resultant product has a good quality without deficiency, such as underfill of the material and has an improved toughness unlike a cast product, a product made by welding and the like of the same structure.

Although the present invention has been explained with reference to a specific, preferred embodiment, one of ordinary skill in the art will recognize that modifications and improvements can be made while remaining within the scope and spirit of the present invention. The scope of the present invention is determined solely by the appended claims.

What is claimed is:

1. A roll forming method for forming an annular product with a radially outwardly extending flange portion at an end by using a mandrel formed with a stepped portion for forming said flange portion comprising the steps of:

holding a center portion of a work for forming said annular product with the mandrel, rotating the work, engaging the work with a forming roller, contacting a portion of the work with the stepped portion of the mandrel, pressing the portion of the work against the stepped portion with the forming roller to form said flange portion, and restricting an outer end of the flange portion from expanding radially outwardly while rolling the work.

2. A roll forming method as recited in claim 1 wherein the step of holding includes holding the center portion of the work at one end and a tail stock, disposed opposite to the mandrel, for urging the work against the mandrel at the other end.

3. A roll forming method as recited in claim 2 wherein the mandrel is formed with a forming tooth portion at a circumferential surface so that a corresponding tooth portion is formed on an inner surface of the work.

4. A roll forming method as recited in claim 2 wherein the forming roller is moved in an axial direction of the mandrel while pressing the portion of the work against the stepped portion of the mandrel.

5. A roll forming device for forming an annular product with a radially outwardly extending flange portion at an end by using a mandrel formed with a stepped portion for forming said flange portion comprising:

a holding device for holding a center portion of a work for forming the annular product, rotation means for rotating the work, a forming roller for engaging the work so that it forces a portion of the work into contact with the stepped portion of the mandrel and presses the portion of the work against the stepped portion to form the flange portion, and restricting means for restricting an outer end of the flange portion from expanding radially outwardly while engaging the work with the forming roller.

6. A roll forming device as recited in claim 5 wherein the holding device includes said mandrel, which holds the center portion of the work at one end, and a tail stock disposed opposite to the mandrel for supporting the work at the other end.

7. A roll forming device as recited in claim 6 wherein the stepped portion is a radially outwardly expanded stepped portion.

8. A roll forming device as recited in claim 6 wherein the mandrel is formed with a tooth portion on an outer surface for forming a corresponding tooth portion on an inner surface of the work.

9. A roll forming device as recited in claim 5 wherein the restricting means is a retaining roller which is brought into contact with an outer end of the flange portion of the work while rotating.

* * * * *